United States Patent [19]

Kanafani et al.

[11] Patent Number: 4,987,280

[45] Date of Patent: Jan. 22, 1991

[54] METHOD FOR MICROWAVE HEATING OF LOW MOISTURE FOOD PRODUCTS

[75] Inventors: Hanny Kanafani, Carrollton; Bobby J. Longan, Plano; Paul R. Schmidt, Lewisville; Lawrence W. Wisdom, Dallas, all of Tex.

[73] Assignee: Recot, Inc., Dallas, Tex.

[21] Appl. No.: 483,494

[22] Filed: Feb. 20, 1990

[51] Int. Cl.[5] ..... H05B 6/64

[52] U.S. Cl. ..... 219/10.55 M; 219/10.55 E; 426/109; 426/113; 426/234; 426/241; 99/DIG. 14

[58] Field of Search ..... 219/10.55 M, 10.55 E, 219/10.55 R, 10.55 F; 426/107, 109, 113, 118, 234, 241, 243; 99/DIG. 14

[56] References Cited

U.S. PATENT DOCUMENTS

| | | | |
|---|---|---|---|
| 3,286,149 | 11/1966 | Brussell | 99/192 |
| 3,287,140 | 11/1966 | Brussell | 426/109 |
| 3,717,478 | 2/1973 | Lipfert | 99/192 R |
| 3,871,357 | 3/1975 | Grosso et al. | 426/113 |
| 4,133,896 | 1/1979 | Standing et al. | 426/107 |
| 4,233,325 | 11/1980 | Slangan et al. | 426/107 |
| 4,259,089 | 7/1981 | Gasbarra et al. | 219/10.55 E |
| 4,419,373 | 12/1983 | Oppermann | 426/234 |
| 4,596,713 | 6/1986 | Burdette | 426/107 |
| 4,705,927 | 11/1987 | Levendusky et al. | 219/10.55 |
| 4,762,113 | 8/1988 | Hamasaki | 426/109 |
| 4,803,088 | 2/1989 | Yamamoto et al. | 426/107 |
| 4,806,371 | 2/1989 | Mendenhall | 426/113 |
| 4,851,246 | 7/1989 | Maxwell et al. | 426/107 |

*Primary Examiner*—Philip H. Leung
*Attorney, Agent, or Firm*—Thomas P. Schur

[57] ABSTRACT

A novel package assembly and method are disclosed whereby a food product having a moisture content of less than 5 weight percent is disposed in a sealed package in which a sealed packet of an aqueous solution is also disposed; so that upon exposure to microwave radiation, the solution in the sealed packet vaporizes, rupture the packet and is dispersed as steam throughout the sealed package, whereby the temperature of the low moisture food product is increased.

15 Claims, 5 Drawing Sheets

METHOD FOR MICROWAVE HEATING OF LOW MOISTURE FOOD PRODUCTS

FIELD OF THE INVENTION

The present invention relates to a package assembly and method for heating low moisture food products using microwave radiation.

BACKGROUND OF THE INVENTION

The use of microwave ovens for the heating of food products has become quite popular, primarily for the convenience provided thereby to consumers. It is estimated that microwave ovens are now in more than seventy percent of all U.S. households. Because of this popularity, a large number of packaged food products are being provided specifically for use with microwave ovens. Specific packaging systems have also been developed for use in microwave ovens.

The majority of microwave products and package assemblies rely on the moisture content contained within the food material for heating the product by microwave radiation. However, certain food products which are low-moisture, shelf-stable products, contain insufficient moisture to permit consistent uniform heating of the product without the product being scorched and/or burned.

There thus remains a need for a product and process permitting uniform heating of low-moisture food products using microwave radiation.

It is therefore one object of the present invention to provide a package assembly for the heating of low-moisture food products by microwave radiation.

It is another object of the present invention to provide a method for heating low-moisture food products with microwave radiation.

These and other objects of the invention will become apparent to one knowledgeable in the art from the below description of the invention and the appended claims.

SUMMARY OF THE INVENTION

The present invention relates to a method of heating a low-moisture food product, having a moisture content of less than five weight percent, comprising the steps of:

(a) providing a food product having a moisture content of less than five weight percent;

(b) providing an aqueous liquid disposed in a sealed packet which is at least partially transparent to microwave radiation;

(c) disposing the low-moisture food product and the sealed packet in a sealed package, which package is transparent to microwave radiation;

(d) irradiating the sealed package with microwave radiation, causing the aqueous liquid in the sealed packet to volatilize and rupture; and (e) dispersing the volatilized liquid as steam throughout the sealed package, so as to increase the temperature of the food product.

DETAILED DESCRIPTION OF THE INVENTION

In accordance with the present invention, shelf stable low-moisture food products can be quickly and reliably heated with steam in a manner which avoids scorching and which does not adversely change the perceived texture of the product.

The package assembly and method disclosed herein is effective for warming foods having moisture contents below about five weight percent. This package assembly and method is especially effective for heating salty snack foods which typically have moisture contents of less than two weight percent. Examples of such salty snack foods include tortilla chips, corn chips, potato chips, pretzels and the like. Such products are typically fried or baked to low-moisture contents, two weight percent or less, packaged in moisture-barrier films, stored and eaten at ambient temperatures. If the products absorb moisture, their textures are altered and the products are organoleptically perceived to be stale.

Surprisingly, the present invention utilizes steam to heat such low moisture food products without incurring any perceived loss of texture and while favorably increasing the flavor and aroma of the products. The present package assembly and method are used to raise the temperature of such low moisture food products by means of microwave radiation to temperatures between about 43° C. (110° F.) and 135° C. (275° F.). Preferably, the low-moisture food products are heated to temperatures of between about 71° C. (160° F.) and 88° C. (190° F.).

The invention is suitable for heating low-moisture products in home microwave ovens, which typically operate in the range of 350–750 watts, as well as in commercial restaurant microwave ovens which may operate as high as 1500 watts.

The invention is desirably carried out by utilizing presently available packaging materials and packaging methods to produce a unique package assembly for low-moisture content foods. The packaging permits the foods to be eaten at room temperature or to be heated by microwave radiation prior to consumption.

The package assembly comprises a sealed packet, containing an aqueous liquid, and the low moisture food product disposed within the cavity of a sealed package. The sealed packet contains a predetermined amount of an aqueous liquid, such as water, an aqueous solution containing a dielectric material, and/or an aqueous solution containing flavor and/or aroma enhancers. Upon exposure to microwave radiation, the contents of the sealed packet rapidly volatilize. The packet's design is such that a seal failure will occur when the interior temperature and pressure reach a predetermined point. When the packet seal fails, the volatalized contents of the sealed package disperse throughout the sealed package.

The sealed packet is formed from food grade packaging materials and may be a rigid container having a separate seal, a flexible container, or other sealed packet. Examples of materials suitable for use as the sealed packet include polyester, cellophane, polypropylene and laminates thereof. Sealant materials include polyethylene, ethylene vinyl acetate, ionomer resins such as those available from the I.E. DuPont Company under the tradename of Surlyn, and mixtures thereof.

The packet and seal material is preferably chosen so that, at the temperature and pressure when the packet ruptures, about all of the contents of the packet will have volatalized and exited the packet.

An amount of aqueous liquid disposed within the sealed packet equal to between one-half and ten weight percent of the food product to be heated is sufficient to accomplish the objectives of the present invention. Preferably, the ratio of food product to aqueous solution in the package assembly ranges from about 1:0.005 to about 1:0.1, and most preferably ranges from about 1:0.01 to about 1:0.09. As an example of the present invention, a sealed package containing 56.7 grams of tortilla chips to be heated will also contain a sealed packet holding about 3 grams of an aqueous liquid. The aqueous liquid may contain additives which hasten the onset of volatility or which impart desirable flavors or aromas to the food product. In one embodiment the aqueous liquid is a sodium chloride solution, preferably between one and ten weight percent sodium chloride, and most preferably between about one and three weight percent sodium chloride. The dielectric properties of a sodium chloride solution dramatically reduce the time required to reach volatile conditions within the sealed packet when that packet is subjected to microwave radiation.

The sealed packet and the low-moisture food product are disposed in a package which can be manufactured using conventional form-fill-and seal techniques and which is made from conventional packaging films. Examples of conventional packaging films include laminates of polypropylene, polyethylene, polyester, glassine and the like. Optionally, the package may contain a structural weakness, such as a weak seal or a pre-weakened spot along one seal, to incipiate a vent for the release of steam from the package to avoid its condensation within the package and on the food product after the product has been heated.

The package assembly is chosen so that when the package is exposed to microwave radiation, the sealed packet therein will rupture within about thirty seconds, disperse its volatilized contents throughout the package and uniformly heat the low-moisture food product in less than an additional 120 seconds, preferably less than an additional 30 seconds.

The following drawings and examples demonstrate the effectiveness of the subject invention. It is to be understood that these drawings and examples are utilized for illustrative purposes only, and are not intended in any way to be limitative of the present invention.

It is noted here that FIGS. 2–5 are further discussed in conjunction with the Examples presented below.

DETAILED DESCRIPTION OF THE DRAWINGS

Figure 1:
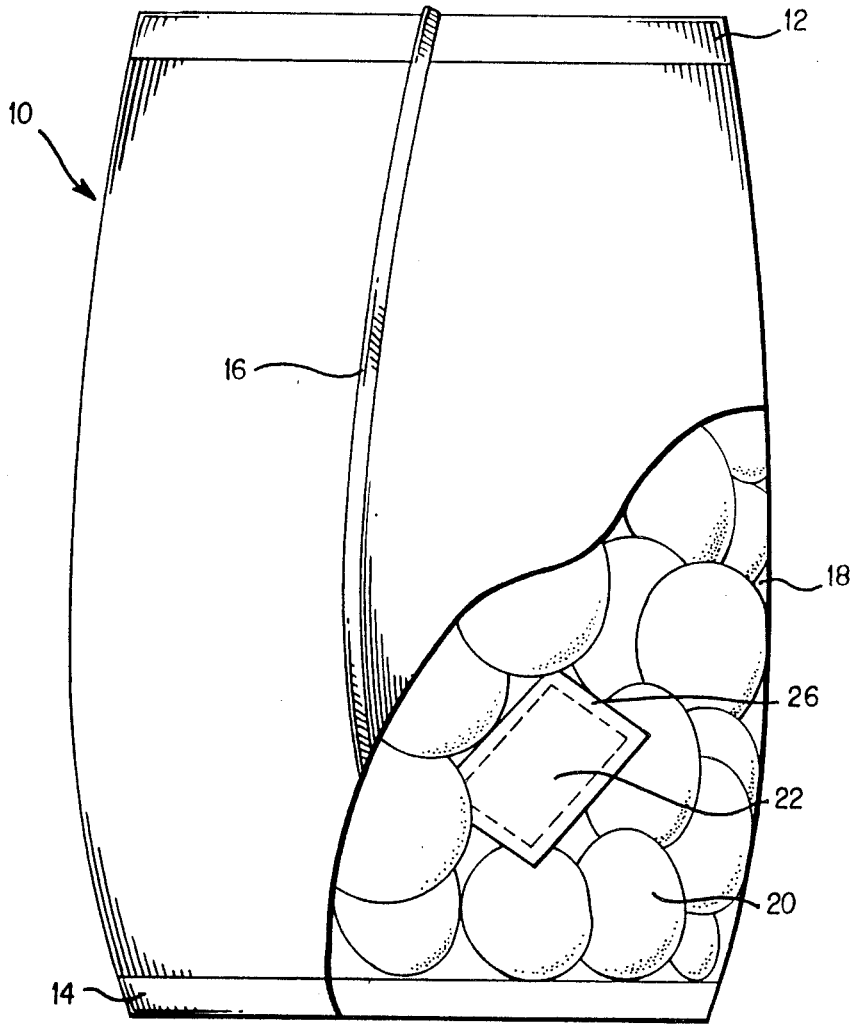
FIG. 1 is a perspective, cut-away view of a package in accordance with one embodiment of the present invention.

In the embodiment shown in FIG. 1, the primary package is a flexible bag 10 constructed from a food grade polymeric or cellulosic structure, such as polymeric film in coextrusion or laminated form which is transparent to microwave radiation. In the embodiment show, package 10 includes end seals 12 and 14, and a longitudinal fin-type seal 16 which can be formed by heat-sealing, ultrasonic-sealing or the like.

The sealed package 10 defines an interior cavity 18 containing a low moisture food product 20, which may be a snack food product such as tortilla chips.

Also contained within the cavity 18 of package 10 is a sealed packet 22 containing an aqueous liquid 24. In the embodiment shown, packet 22 is formed of radiation-transmissive polymeric or cellulosic flexible film material sealed along its outer edges 26 using an adhesive sealant, thermal sealing, ultrasonic sealing or the like.

In accordance with the present invention, the low-moisture food product 20 is heated by placing package 10, along with its contents sealed therein, in a microwave oven and subjecting the bag to microwave radiation within the oven. The microwave radiation excites the aqueous liquid molecules in the sealed packet, causing the liquid to rise in temperature. Because of the concentration of liquid 24 in packet 22, relative to the small amounts of moisture present in the food product 20, liquid 24 heats at a noticeably faster rate from the exposure to microwave radiation than the food product 20.

The aqueous liquid 24 vaporizes into steam, causing packet 22 to expand and the pressure inside packet 22 to increase. The increased pressure within packet 22 causes the pressure of vaporization to increase, until the pressure inside packet 22 exceeds the strength of the seals formed at edges 26. This increased pressure causes packet 22 to rupture along the sealed edge 26, allowing the steam to disperse into the cavity 18 of package 10 and heat the food product 20.

The aqueous liquid 24 within packet 22 may contain water alone, or may be a solution of an electrolytic material, such as a 1% NaCl solution, or may be an aqueous solution containing flavor-enhancing and/or aroma-enhancing ingredients which are vaporized along with the water and are carried into the package cavity 18 with the steam when the packet ruptures.

Continued application of microwave radiation to the sealed package 10 after the packet 22 has ruptured, causes continued heating of the steam and the food product. When the interior pressure of the package 10, generated by continued heating, exceeds the strength of one or more seals of package 10, the package ruptures with an audible "burst."

The types of package seals used can predetermine the location of the bag opening for consumer use. For example, a bag having a longitudinal fin seal 16, as shown, will result in the longitudinal seams 16 opening at the end of the heating cycle, rather than the end seals 12 and 14 of the package. Thus, if the bag is adapted to open along it's longitudinal seam 16, it is preferred to heat the bag with the longitudinal seam 16 oriented upwardly.

If a lap-type seal is used to form the longitudinal seam of the package 10, steam pressure within the package can be utilized to open an end seal of the package, rather than the longitudinal seam. If the package is adapted for end seal opening, one of the end seals can be made weaker than the other, using techniques known in the art, to control which end seal opens under pressure.

Alternatively, a weakness designed into the packaging film can provide a relief vent for the steam generated inside the package and avoid failure of any seals.

By heating until a package or seal failure creates an escape for the steam inside the package, the moisture content of the food product remains low and ensures that the steam used to heat the product does not perceptively alter the product's organoleptic characteristics in a negative fashion.

EXAMPLES

Example 1

This Example demonstrates the preferred product heating obtainable by practicing the present invention. In this example the two packages were prepared and heated in a 530 watt microwave oven on full power for three minutes. Each package was formed from a laminate having the structure: 75 gauge oriented polyepropylene, 3.5# polyvinylidene chloride, 10# polyethylene, 60 gauge coextruded polyester sealant. Both packages were filled with 53 grams of tortilla chips available from Frito-Lay, Inc. under the tradename TOSTITOS. The tortilla chips had an initial moisture content of 1.1 weight percent.

The control package was sealed with the tortilla chips therein. Into the second package, along with the tortilla chips, was inserted a packet formed from a laminate of 50 gauge oriented polyester, adhesive and sealant in which was sealed 3 grams of water. The second package comprises a package assembly in accordance with the present invention.

Figure 2:
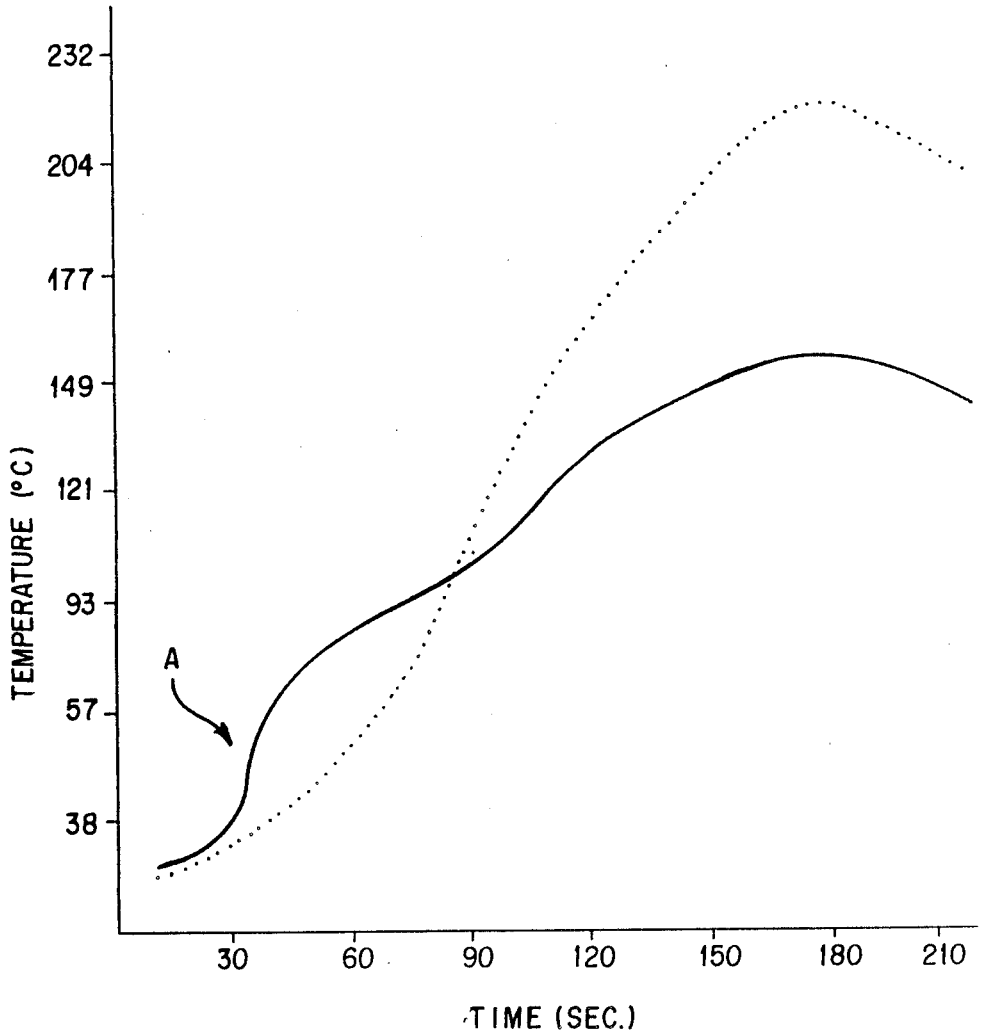
FIG. 2 is a graph of food product temperature as a function of time for two package assemblies, one in accordance with the present invention and one which does not follow the present teaching.

The temperature profile of the tortilla chips heated in the control package is shown on the graph in FIG. 2 as a dotted line. The temperature profile of the tortilla chips heated in a package assembly as disclosed herein is depicted in FIG. 2 as a solid line. At about thirty seconds the sealed packet in the inventive package assembly ruptured, producing a sudden increase in product temperature to about 75° C. (167° F.), as designated in the Figure by arrow A. Thereafter, the steam in the sealed package raised the product temperature in a controlled manner, gradually leveling off at about 149° C. (300° F.) and prevented overheating of the tortilla chips. The heated product was accompanied by a flavorful aroma and retained its crisp texture. Conversely, the tortilla chips in the control package gradually warmed for about the first sixty seconds to a temperature of only about 49° C. (120° F.), then heated rapidly to a temperature in excess of about 204° C. (400° F.), indicating a strong likelihood that the product was burnt and/or scorched, which was confirmed upon subsequent inspection.

Example 2

This example demonstrates the controlled dispersion of water vapor from the sealed packet that is obtained by the selective use of an aqueous electrolytic solution.

Packets having about 18 cc volumes were formed from a laminate of 50 gauge oriented polyester, adhesive and sealant. Into one set of packets was sealed three grams of distilled water. A second set of sealed packets contained a 1% NaCl solution. The sealed packets were heated in a 530 watt microwave oven for one minute. Packets were sampled at the time of rupture and at fifteen second intervals to determine the amount of liquid that had been vaporized. The dispersion efficiencies of these packets are shown in FIG. 3.

Figure 3:
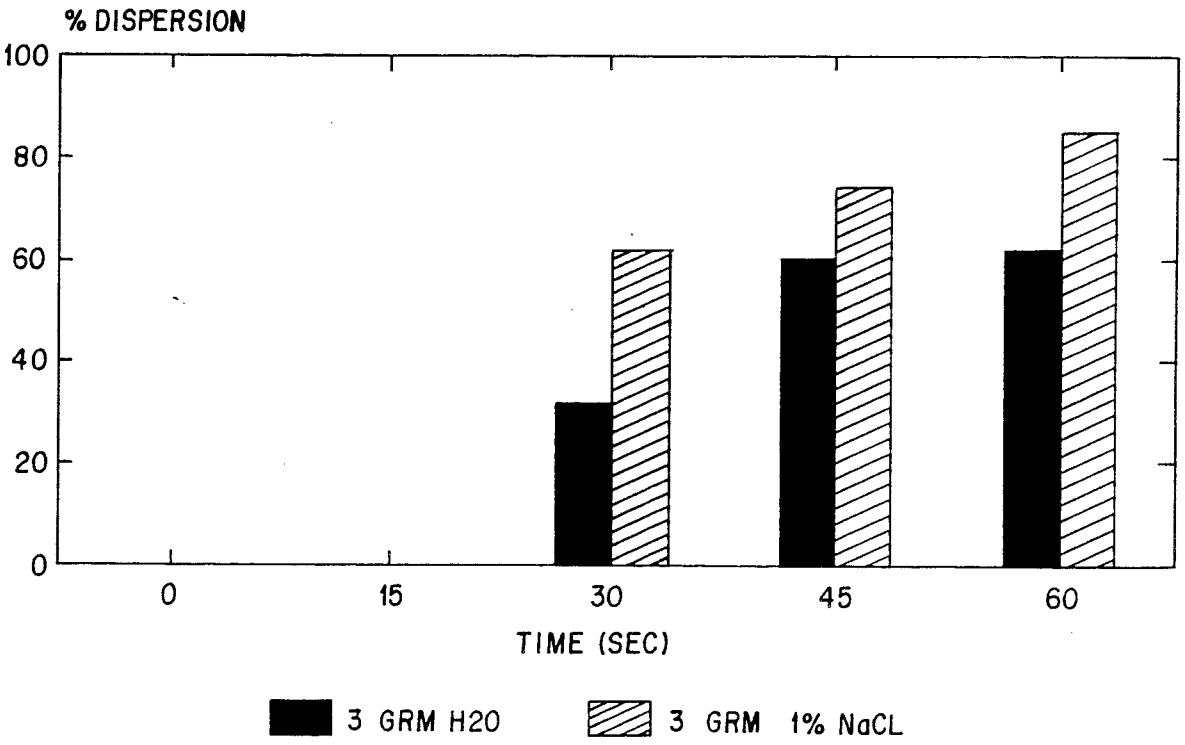
FIG. 3 is a graph showing the dispersion efficiencies of two aqueous solutions when disposed in sealed packets and subjected to microwave radiation.

As can be seen from FIG. 3, after about thirty seconds the temperature and pressure within the sealed packets of distilled water caused the packets to rupture with an immediate release of about thirty weight percent of the water as water vapor. Over the ensuing thirty seconds, about an additional thirty weight percent of the distilled water was vaporized, for a total vaporization efficiency of about sixty weight percent. As the dispersion of water vapor is an important aspect of this invention for uniformly heating a low moisture food product, the use of distilled water as shown in Example 1 is effective, but as shown in this Example, is not highly efficient.

Temperature and pressure generated by microwave heating caused the 1% NaCl solution-filled packets to rupture after about fifteen seconds. After about thirty seconds, more than sixty weight percent of the contents of the pouch had dispersed as vapor. In the next thirty seconds, more than an additional twenty weight percent of the solution vaporized and dispersed for a total dispersion of more than eighty-five weight percent. The efficiency and resulting effectiveness of the sealed packet to heat low moisture foods by microwave radiation is thus enhanced through the use of an electrolytic solution in the sealed packet.

Example 3

Figure 4:
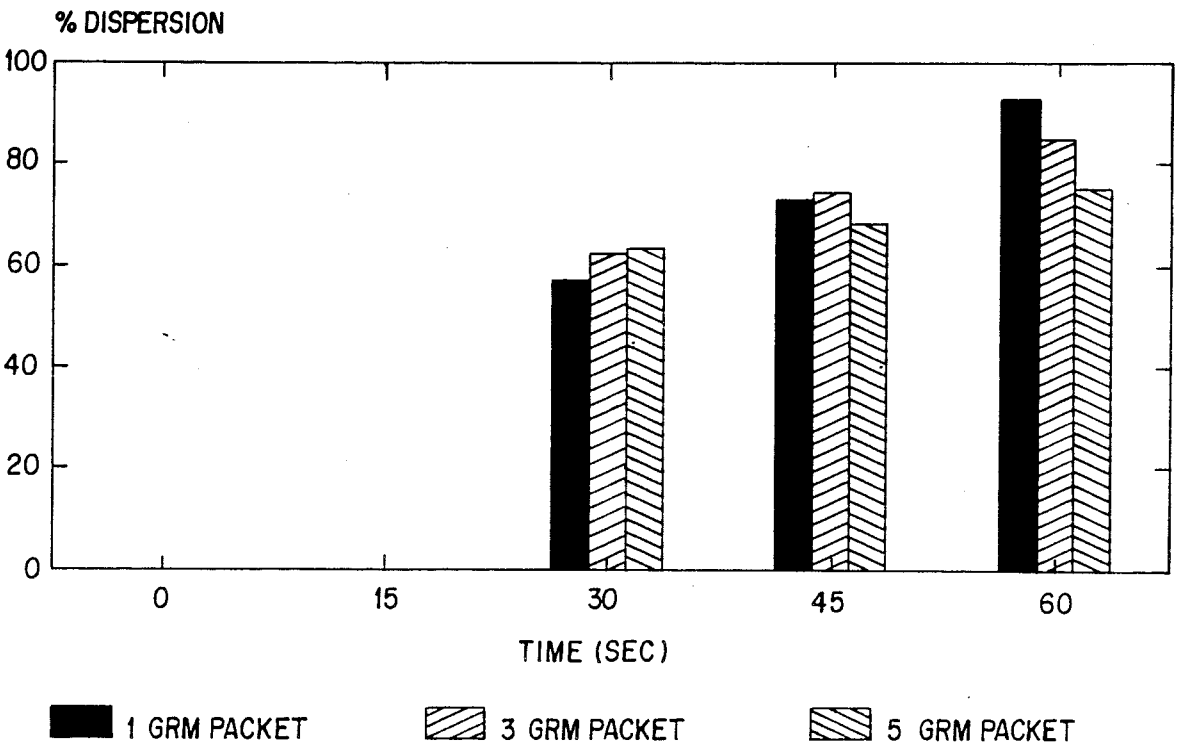
FIG. 4 is a graph representing the dispersion efficiencies of varying amounts of a 1% NaCl solution from a sealed packet.

The dispersion efficiencies of sealed packets containing various amounts of electrolytic solutions are shown in FIG. 4. There is displayed in FIG. 4 the percent dispersion of steam vapor from sealed packets containing one, three and five grams of 1% NaCl solution. These packets were subjected to the same heating conditions as described in Example 2 above.

As can be seen, the dispersion efficiency is relatively independent of the amount of solution in the sealed packet over this range, each amount being successful in vaporizing at least 50 weight percent of its contents in the first thirty seconds of heating, and dispersing as a vapor at least 75 weight percent of its contents after sixty seconds of heating.

EXAMPLE 4

In this Example, the variation in product temperature when heated in a package assembly, and in accordance with the method taught herein, will be demonstrated. The same packaging materials and food product described for use in Example 1 were used in this Example. Sealed packages containing 56 grams of TOSTITOS® brand Tortilla Chips and a sealed packet containing either 1 gram or 5 grams of a 1% NaCl solution were subjected to microwave heating in a 530 watt oven at full power for sixty seconds. The temperature profiles of the tortilla chips are shown in FIG. 5 as a function of time.

The temperature profile of the food product heated in the package assembly utilizing 1 gram of 1% NaCl solution is shown by a dotted line. The temperature profile of the food product heated in the package assembly utilizing 5 grams of 1% NaCl solution is shown by a dashed line. The temperature profile of a control package having no sealed packet therein is depicted by a solid line.

Figure 5:
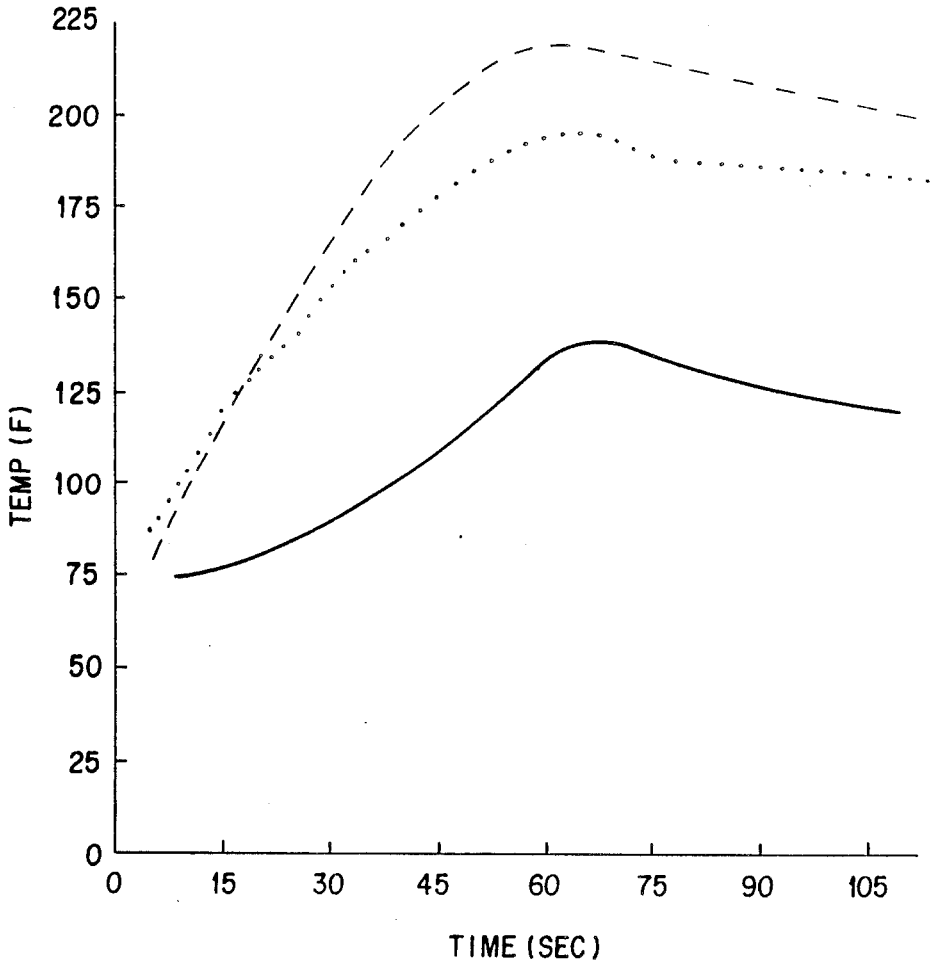
FIG. 5 is a graph of food product temperatures as a function of time for package assemblies in accordance with the present invention that utilize different amounts of liquid in the sealed packet.

Referring to FIG. 5, it is note worthy that the rate of product heating began to increase dramatically at about ten seconds, for the package assemblies containing the 1 gram and 5 grams 1% NaCl solution-filled packets, when the packets ruptured and vapor began to fill the package. The average product temperature plateaued after 60 seconds, at which time the microwave power was turned off. The product temperature heated with the 5 gram 1% NaCl solution-filled packet was stable at about 104° C. (220° F.), the product temperature heated in the 1 gram 1% NaCl solution-filled packet was stable at about 91° C. (220° F.), while the temperature of the product in the control package had only reached about 56° C. (133° F.). Thus, the controlled dispersion of liquid will not only aid in heating, but can also determine the final product temperature which contributes to optimizing the flavor, aroma and texture that is most organoleptically acceptable to the consumer.

Inasmuch as the present invention is subject to many variations, modifications and changes of detail, a number of which have been expressly stated herein, it is intended that all matter described throughout this specification or shown in the accompanying drawings be interpreted as illustrative and not in a limiting sense. It is evident that a packaging assembly constructed in accordance with the present invention and the method of using such a packaging assembly and reasonable equivalents thereto will accomplish the objects of the present invention. The scope of the invention is intended to include all modifications and variations that fall within the scope of the attached claims.

We claim:

1. A method of heating a low-moisture food product, having a moisture content of less than five weight percent, comprising the steps of:

(a) providing a food product having a moisture content of less than five weight percent;

(b) providing an aqueous solution disposed in a sealed packet which is at least partially transparent to microwave radiation;

(c) disposing the low-moisture food product and the aqueous solution-containing sealed packet in a sealed package, which package is transparent to microwave radiation;

(d) irradiating the sealed package with microwave radiation, causing the aqueous liquid in the sealed packet to volatilize and rupture said packet after less than thirty seconds of exposure to microwave radiation; and (e) dispersing the volatilized liquid as steam throughout the sealed package so as to increase the temperature of the food product.

2. The method in accordance with claim 1 wherein, the step of providing a food product, the food product has a moisture content of less than two weight percent.

3. The method in accordance with claim 1 wherein, in the step of providing a food product, food product is a salty snack food.

4. The method in accordance with claim 1 wherein, in the step of providing an aqueous solution, the aqueous solution contains a dielectric material.

5. The method in accordance with claim 4 wherein the aqueous solution comprises a sodium chloride solution having from 1 to 10 weight percent sodium chloride.

6. The method in accordance with claim 4 wherein the aqueous solution comprises a sodium chloride solution having from 1 to 3 weight percent sodium chloride.

7. The method in accordance with claim 1 wherein the temperature of said food product is increased to between 43° C. (110° F.) and 135° C. (275° F.).

8. The method in accordance with claim 1 wherein the temperature of said food product is increased to between 71° C. (160° F.) and 88° C. (190° F.).

9. The method in accordance with claim 1 wherein, in the step of disposing the low moisture food product and the aqueous solution containing packet in a sealed package, the ratio of food product to aqueous solution disposed in the sealed package ranges from about 1:0.005 to about 1:0.1.

10. The method in accordance with claim 1 wherein, in the step of disposing the low moisture food product and the aqueous solution containing packet in a sealed package, the ratio of food product to aqueous solution disposed in the sealed package ranges from about 1:0.01 to about 1:0.09.

11. The method in accordance with claim 1 wherein said food product is heated in less than 150 seconds.

12. The method in accordance with claim 1 wherein said food product is heated in less than 60 seconds.

13. A method of heating a food product having less than two weight percent moisture, comprising the steps of:

(a) providing a food product having a moisture content of less than two weight percent;

(b) providing an aqueous electrolytic solution in an amount such that the ratio of the food product of step (a) to the aqueous electrolytic solution ranges from 1:0.005 to 1:0.1, the solution disposed in a sealed packet which is at least partially transparent to microwave radiation;

(c) disposing the low-moisture food product and the aqueous solution-containing sealed packet in a sealed package, which package is transparent to microwave radiation;

(d) irradiating the sealed package with microwave radiation, causing the aqueous solution in the sealed packet to volatilize and rupture said packet after less than thirty seconds of exposure to microwave radiation; and (e) dispersing the volatilized solution as steam throughout the sealed package so as to increase the temperature of the food product to between 43° C. (110° F.) and 135° C. (275° F.).

14. A method of heating a salty snack food having less than two weight percent moisture, comprising the steps of:

(a) providing a salty snack food having a moisture content of less than two weight percent;

(b) providing an aqueous electrolytic solution in an amount such that the ratio of the salty snack food of step (a) to the aqueous electrolytic solution ranges from 1:0.01 to 1:0.09, the solution disposed in a sealed packet which is at least partially transparent to microwave radiation;

(c) disposing the low-moisture food product and the aqueous solution-containing sealed packet in a sealed package, which package is transparent to microwave radiation;

(d) irradiating the sealed package with microwave radiation, causing the aqueous solution in the sealed packet to volatilize and rupture said packet after less than thirty seconds of exposure to microwave radiation; and (e) dispersing the volatilized solution as steam throughout the sealed package so as to increase the temperature of the food product to between 71° C. (160° F.) and 88° C. (190° F.).

15. The method in accordance with claim 14 wherein in the step of providing an aqueous electrolytic solution, the solution is a sodium chloride solution.

* * * * *